United States Patent [19]

George

[11] Patent Number: 4,724,757

[45] Date of Patent: Feb. 16, 1988

[54] PRESS CONTROL AND ARRANGEMENT FOR COMPRESSING PARTICLEBOARD

[75] Inventor: David W. George, New Castle, Pa.

[73] Assignee: Wean United, Inc., Pittsburgh, Pa.

[21] Appl. No.: 892,314

[22] Filed: Aug. 4, 1986

[51] Int. Cl.[4] ..... B30B 15/22; B30B 7/00

[52] U.S. Cl. ..... 100/46; 100/237; 100/43; 425/141; 425/338

[58] Field of Search ..... 100/214, 43, 46, 50, 100/99, 258 R, 258 A, 269 B, 269 R, 295, 237; 425/141, 338

[56] References Cited

U.S. PATENT DOCUMENTS

| | | | |
|---|---|---|---|
| 2,809,543 | 10/1957 | Zeitlin | 100/258 A |
| 3,070,146 | 12/1962 | Ferranti | 100/46 X |
| 3,411,345 | 11/1968 | Wintriss | 100/99 |
| 3,600,747 | 8/1971 | McCarty | 18/2 C |
| 3,626,165 | 12/1971 | McCall | 235/151.3 |
| 4,222,724 | 9/1980 | Van Hullen | 425/141 |
| 4,289,467 | 9/1981 | Pesch | 425/141 |
| 4,429,627 | 2/1984 | Edso | 100/43 X |

FOREIGN PATENT DOCUMENTS

| | | | |
|---|---|---|---|
| 2630966 | 1/1978 | Fed. Rep. of Germany | 100/46 |

*Primary Examiner*—Andrew M. Falik

*Attorney, Agent, or Firm*—Suzanne Kikel

[57] ABSTRACT

A press having a stationary upper bolster and a movable lower bolster carried by two outer and two inner frame plates located near the ends and center of the platens respectively. Through the use of strain gauges measuring the load on the product provided on either sides of each frame plate and servo-operated piston cylinders connected to the lower bolster controlling the output force, a deflection of the lower bolster is made to be parallel to the deflection of the upper bolster so that an equal pressure distribution results in compression therebetween thereby producing a uniform thickness in the product.

6 Claims, 5 Drawing Figures

PRIOR ART-BOARD SAME LENGTH AS BOLSTERS

PRESENT INVENTION-BOARD SAME LENGTH AS BOLSTERS

PRIOR ART-BOARD SHORTER THAN LENGTH OF BOLSTERS

PRIOR ART-BOARD SHORTER THAN LENGTH OF BOLSTERS
(UNEVEN MAT)

PRESENT INVENTION-BOARD SHORTER THAN LENGTH OF BOLSTERS

PRESS CONTROL AND ARRANGEMENT FOR COMPRESSING PARTICLEBOARD

BACKGROUND OF THE INVENTION

The present invention pertains to a platen press for compressing a product, such as particleboard, copper laminate or the like, and a control for computing and regulating the loads on the frame plates of the press to attain uniform thickness of the product.

In both single and multiple opening presses, the bolster and/or several platens forming the openings are carried by two or more uprights. These uprights are spaced-apart frame plates located at opposed longitudinal ends of the platens. Hydraulic cylinder assemblies are provided in the frames to bring the bolsters together to close the press and to apply the required pressure distribution to compress the product. The distance between the two or more frame plates with their respective cylinders is normally set up to accommodate the maximum length of the product. The bolsters through the cylinders compress the product to a substantial uniform thickness.

In this arrangement for a press problems arise with non-uniform loading on the bolsters caused by a product shorter in length than that of the bolsters and platens. In pressing the shorter lengths, especially in a single opening press with an upper and lower bolster, the amount of deflection along the bolsters varies between a minimum and maximum deflection. The deflection curve for the top and bottom bolsters either results in being a mirror image or the reversal of each other, where heavier loads may exist at the ends of the bolsters with lighter loads in the center, or vice versa.

Deflection of this type results in non-uniformity of product thickness. This requires grinding to obtain a uniform product thickness after the pressing process. This leads to excessive loss of time, waste of material, and expense in both labor and equipment, which is totally unacceptable to the particle board and laminate industry.

SUMMARY OF THE INVENTION

For the above reasons there is the need to provide a control and arrangement in a press for compressing a product which would produce a uniform thickness along the product's length regardless of whether the product is substantially the same length as the bolsters and platens or shorter. One form of the present invention provides a solution to this problem by providing a total of four or more frames with two or more spaced-apart cooperatively controlled frame plates located near the center and two or more cooperatively controlled frame plates each located toward either end of the bolsters. Strain links are mounted along the vertical section of the frame plates near the opening of the press for measuring the loads placed on the bolsters and platens during compression of the product. The readings of the strain links are fed into a programmable controller. Pressure transducers detect the pressure in servo-controlled hydraulic cylinder assemblies carried by each frame plate to increase or decrease the supply of hydraulic fluid in order to apply an appropriate pressure against the lower bolster so that the distance between the upper and lower bolsters is made to be substantially equal along the length of the product to compress the product with a substantially uniform thickness. The cylinder assemblies of the inner frame plates are hydraulically connected to be operated simultaneously as are the outer frame plates.

A broad object of the present invention is to provide a control and device for computing and regulating loads on a frame plate press to attain uniform loading on the product, and therefore uniform thickness thereof whereby a great amount of time is saved, less material is wasted, and labor and equipment costs are lessened compared to the prior art.

A further object of the present invention is to operate the bolsters of a press such that when pressing different lengths of particleboard, the deflection of the one bolster is made to correspond to that of the other so that the spacing therebetween is the same along their lengths resulting in generally a uniform thickness product.

A still further object of the present invention is to provide a device used in a press for compressing several sheets of material together in a laminating process which acts as a safety device to prevent overloading and thus damage to the press.

These features as well as other novel features and advantages inherent in the present invention will be better appreciated and understood when the following description is read along with the accompanying drawings of which:

FIG. 1 is a schematic, illustrating a single opening press platen and a hydraulic and electrical control means involved for attaining the objects of the present invention;

FIG. 2*a* is a schematic representation of a deflection occurring in a long length product as a result of both the prior art and the present invention;

FIG. 2*b* is a schematic representation of a deflection occurring in a short length product as a result of the prior art and is a first possible condition;

FIG. 2*c* is a schematic representation of a deflection occurring in a short length product with uneven matting as a result of the prior art and is a second possible condition; and FIG. 2*d* is a schematic representation of a deflection occurring in a short length product as a result of the present invention.

DETAILED DESCRIPTION OF A PREFERRED EMBODIMENT

Figure 1:
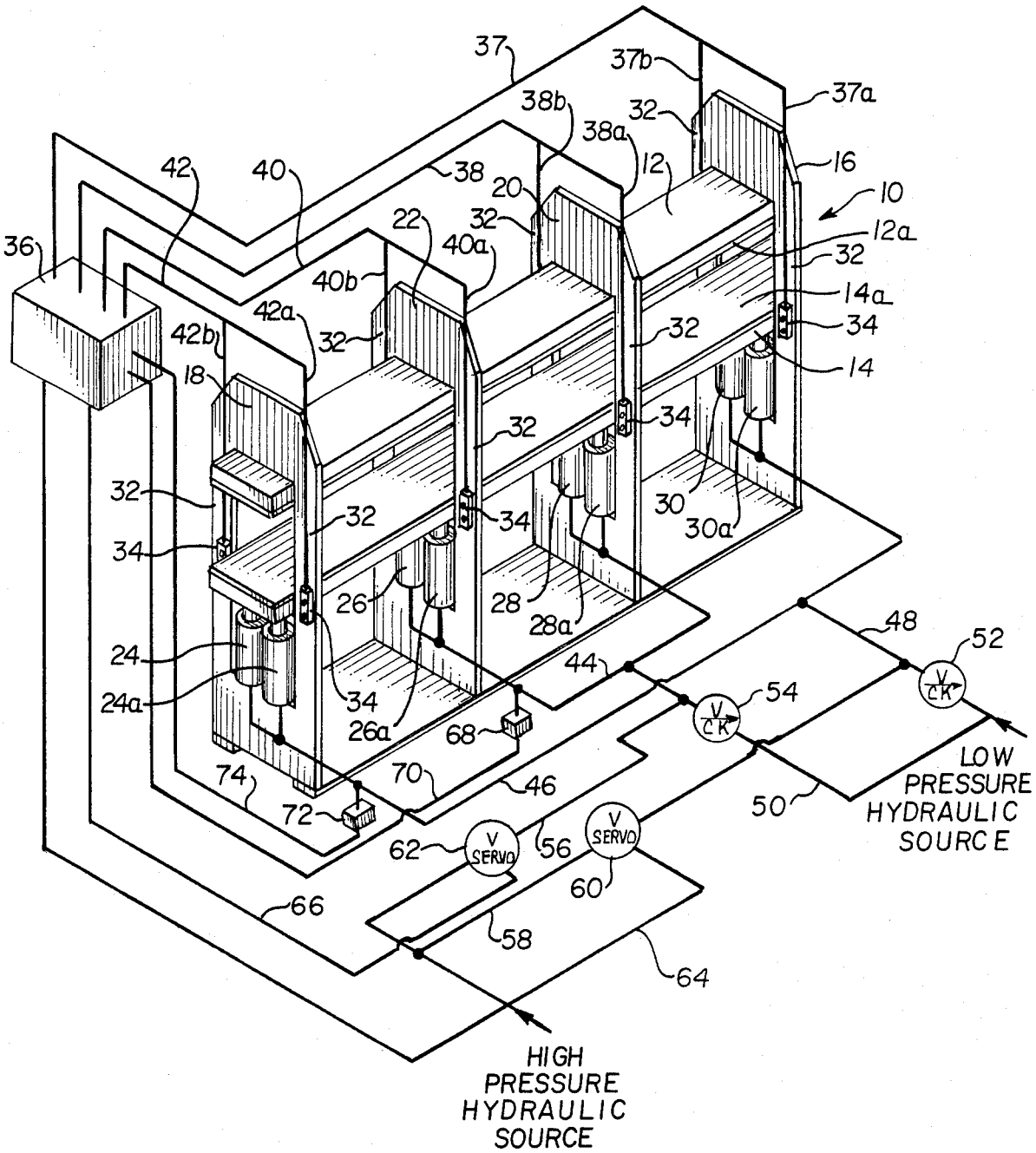

FIG. 1 illustrates schematically a single opening press 10 for compressing several layers of material together to form a particleboard or a laminate, such as copper clad used to produce printed circuit boards. A multi-platen press operating on the same general principles as a single opening press such as the present invention for pressing particle boards or laminated boards is disclosed in U.S. Pat. No. 4,222,724 to Van Hüllen on Sept. 16, 1980 which is incorporated herein by reference.

The single opening platen press 10 of FIG. 1 consists of a stationary upper bolster 12 carrying a platen 12*a* and a movable lower bolster 14 carrying a platen 14*a* onto which platen 14*a* the board to be pressed is placed by an external device in a manner known in the industry. An opening for press 10 is defined when bolsters 12 and 14 are spaced away from each other and a closing for press 10 is defined when the bolsters 12, 14 are positioned close to each other. Bolsters 12 and 14 are carried by outer frame plates 16 and 18 and inner frame plates 20 and 22 and lower bolster 14 is raised and lowered relative to upper bolster 12 by hydraulic cylinder assemblies 24, 24*a*, 26, 26*a*, 28, 28*a* and 30, 30*a* in frame plates 16–22, which cylinder assemblies 24–30*a* operate similarly to the above U.S. Pat. No. 4,222,724. Frame plates 16–22 are tandemly arranged and generally equally spaced relative to each other.

Mounted along a vertical portion 32 on each side of the frame plates 16, 18, 20, and 22 is a strain link 34 which sends an electrical signal to a programmable controller 36, more about which will be discussed shortly. This electrical signal represents the load placed on the frame plates 16, 18, 20, and 22 by the board when the lower bolster 14 is brought upwardly by the several cylinder assemblies 24–30*a* for compression of the board. Strain links 34 can be purchased from Lebow Associates in Troy, Mich., U.S.A. This electrical signal from each strain link 34 to programmable controller 36 is represented by lines 37, 38, 40, and 42 located at the top of FIG. 1 which lines 37–42 represent the difference between the associated signals along the a and b lines for each signal line 37–42.

The lower portion of FIG. 1 illustrates the various hydraulic and electrical connections from the high and low pressure hydraulic fluid sources to the several cylinder assemblies 24–30, and from the cylinder assemblies 24–30 to the programmable controller 36. Commencing from the inside outwardly of these various line connections it can be seen as indicated by line 44 that the cylinder assemblies 26, 28 of the inner frame plates 20 and 22 are operated in unison, and as indicated by line 46 that the cylinder assemblies 24, 30 of outer frame plates 16 and 18 are operated in unison.

Low pressure hydraulic fluid at approximately 200 pounds per square inch is pumped as shown into line 48 and into line 46 for the outer frames 16, 18 and into line 50 and into line 44 for the inner frames 20, 22 by a centrifugal pump (not shown) into the piston side of the several piston cylinder assemblies 24, 30 of the outer frame plates 16, 18 and into assemblies 26, 28 of inner frame plates 20, 22. Control for the low pressure hydraulic flow is regulated by pilot operated check valves 52 and 54 in lines 48 and 50, respectively. The low pressure hydraulic fluid is used to close the press, i.e. lower bolster 14 is brought upwardly toward upper bolster 12 whereas the high pressure hydraulic fluid is used to supply the pressures needed to compress the particleboard.

Compression of the board generally requires a further raising of lower bolster 14. A pressure switch (not shown) is automatically activated by the controller 36 to close off the low pressure side and to open the high pressure side. Hydraulic fluid from the high pressure side is pumped at a pressure of approximately 3,000 to 5,000 pounds per square inch by a high pressure pump (not shown) into the piston side of the several piston cylinder assemblies 26–28 of the inner frame plates 20 and 22 as shown by line 56 leading into line 44 to the piston cylinder assemblies 26 to 28 of the inner frame plates 20, 22, and into that of outer frame plates 16 and 18 as shown by line 58 leading into line 46 to the piston cylinder assemblies 24, 30 of the outer frame plates 16, 18.

The fluid flow on the high pressure side through lines 56, 58 is regulated by servo-valves 60 and 62 which are operated electrically by controller 36. As line 58 shows, servo-valve 60 regulates the pressure in the cylinder assemblies 24, 30 of the outer frame plates 16 and 18, and line 56 regulates the pressure in cylinder assemblies 26, 28 of inner frame plates 20, 22. To the bottom of FIG. 1 line 64 connects servo-valve 60 to controller 36, and line 66 connects servo-valve 62 to controller 36. Servo valves 60, 62 are electrohydraulic servomechanisms and operate according to well-known practice in that it measures its own output and forces the output to quickly and accurately follow a command signal from controller 36. The servo-valves 60, 62 may be of the Moog 72 Series purchased from Moog Inc. Controls Division, East Aurora, N.Y., U.S.A.

The actual pressure in the piston cylinder assemblies 26, 28 of inner frame plates 20, 22 is detected by a pressure transducer 68 in line 70 which sends an electrical signal to controller 36 as indicated by line 70. A second pressure transducer 72 in line 74 detects the actual pressure in the cylinder assemblies 24, 30 of outer frame plates 16 and 18 and sends an electrical signal to controller 36 through line 74. The signals sent by pressure transducers 68, 72 to controller 36 are compared to a desired pressure previously programmed into the controller 36, which programmable controller 36 may be designated PAC5 Model 5110 purchased from Automation Systems of Iowa, U.S.A.

If there is a difference between the actual measured pressure value and the desired pressure value on the high pressure side, the programmable controller 36 sends a signal through lines 64 and 66 to the servo-valves 60 and 62, respectively to regulate the pressure on the high pressure side to deliver an amount of hydraulic fluid flow proportional to the required pressure value which is necessary to bring the difference between the actual measured pressure values and the desired pressure values for cylinder assemblies 24–30 to zero.

Figure 2A:
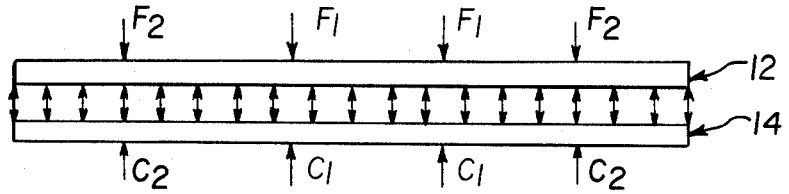
Figure 2A:
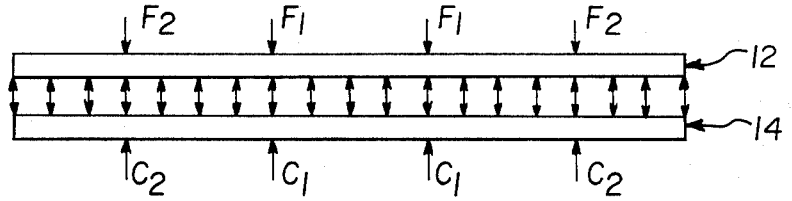

FIG. 2*a* illustrates a particleboard having a length approximately the same length as the upper and lower bolsters 12, 14. In both the prior art press design and the present invention press design a substantially uniform load is placed on the bolsters 12, 14 by a board represented by the double-head arrows and as can be seen the deflection curve for both the top and bottom surfaces of the board follows that of the upper and lower bolsters 12, 14, which is generally parallel, i.e., the distance between upper and lower bolsters 12, 14 incrementally along their lengths is substantially the same. As mentioned previously, the press for pressing laminates or particleboard of the prior art generally has two spaced-apart frame plates located at the extreme ends of the platens which may generally be positioned in the same location as the two outer frame plates 16, 18 of the present invention depicted in FIG. 1. These frame plates of the prior art are represented by $F_2$ and the effect of their respective cylinders by $C_2$ in the prior art representation of FIGS. 2*a*–2*d*. The frame plates 16, 18, 20, 22 and their applied force for the present invention are represented by $F_1$, $F_2$ and the effect of their respective cylinders 24–30 are represented by $C_1$, $C_2$ in FIGS. 2*a*–2*d*. In FIG. 2*a*, certain deflections are being discounted at the end of the bolsters 12, 14 since these deflections are within tolerances.

Figure 2B:
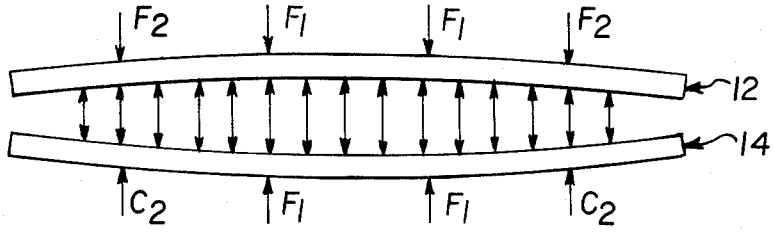
Figure 2C:
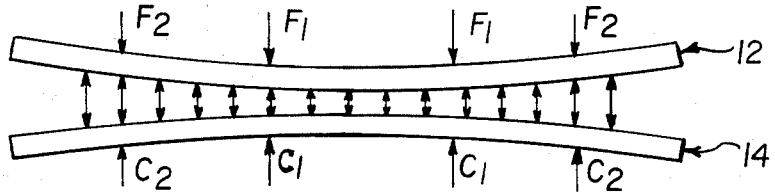

In FIGS. 2*a*–2*d*, $F_1$, $F_2$ indicate the downward force the frame plates of the press have on the upper bolster, and therefore the particleboard. FIGS. 2*b* and 2*c* illustrate a configuration a board with a length less than the length of the bolsters 12, 14 generally may take due to the uneven load distribution of the board at its ends against the bolsters 12, 14, where the cylinder assemblies of the frame plates are ineffective in compensating for the deflection of a shorter board due to the location of the frame plates away from the ends of the shorter board and/or the uneven matting of the particleboard.

As mentioned earlier, in a pressing operation the loads at the ends of the board may be greater as shown in FIG. 2*c*, or lesser as shown in FIG. 2*b*, than the load in the center of the board indicated by the length of the double-headed arrow in these FIGS. 2*b* and 2*c*.

Figure 2D:
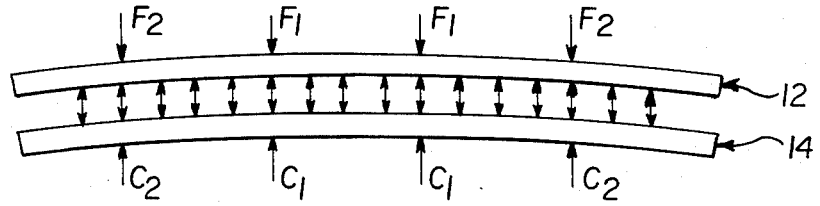

FIG. 2*d* illustrates a configuration a board with a length less than the length of bolsters 12, 14 takes due to the teachings of the present invention. Inner frame plates 20, 22 are indicated by $F_1$ whose counteracting forces in conjunction with the pressure in their respective cylinder assemblies indicated by $C_1$ result in an even load distribution along the length of the shorter board between bolsters 12, 14. The cylinder assemblies 24, 26, 28 and 30 of the inner frame plates 20, 22 and outer frame plates 16, 18 are controlled to receive the required amount of hydraulic fluid in order to apply a pressure proportional to the compressibility factor of the particleboard. The outer cylinder assemblies 24, 30 of the outer frame plates 16, 18 may have a fluid volume and therefore a pressure value greater or less than those of the inner frame plates 20, 22 depending on which of the two conditions in FIGS. 2*b* and 2*c* occur in the compression operation for the board.

Computer tests ran by the inventor have shown that a board approximately 146 inches long may result in a 0.001" maximum deflection difference between the upper and lower bolsters 12, 14. This is an insignificant amount for the required thickness uniformity in the particleboard being pressed. These tests also show that a board of approximately 122 inches results in a maximum deflection difference of 0.088 inch between the two bolsters 12, 14 prior to the cylinder assemblies 24–30 controlling the pressure distribution. This 0.088 inch difference represents a substantial distance which when the cylinders 24–30 are brought under control can be reduced to a 0.005 inch maximum deflection difference between the two bolsters 12, 14. These results show that the teachings of the present invention result in substantial uniform thickness of the particleboard.

Operation of press 10 of the present invention is as follows: A particleboard or laminate which is to be compressed is placed by an external device between the upper and lower platens 12*a*, 14*a* of bolsters 12, 14 respectively. The same low hydraulic pressure is delivered through lines 44, 46, 48 and 50 into the piston cylinder assemblies 24–30 of frame plates 16, 18, 20 and 22 to simultaneously raise lower bolster 14 upwardly toward upper bolster 12 until the board on lower bolster 14 touches the undersurface of upper platen 12*a*. Check valves 52, 54 are activated to close off the low pressure side for the hydraulic fluid, and servo-valves 60, 62 are set into operation for the hydraulic fluid on the high pressure side. While this occurs, pressure transducers 68, 72 detect the pressure in cylinder assemblies 24–30, and strain links 34 are continually monitoring the stretch or load on frame plates 16–22.

In compressing the particle board, fluid from the high pressure hydraulic source is delivered to close press 10 until the board places a load distribution on bolsters 12, 14. Strain links 34 on each frame plate 16–22 detect the load distribution on bolsters 12, 14 and send a proportional electrical signal through lines 37–42 to programmable controller 36. When the board is substantially the same length as bolsters 12, 14, the servo-valves 60 and 62 operate to simultaneously deliver a sufficient and substantially equal volume of hydraulic fluid to the cylinder assemblies 24, 26, 28, 30 of both the outer and inner frame plates 16–22. When a board shorter in length than bolsters 12, 14 is being compressed, strain links 34 of outer frames 16, 18 will in most cases read different values than those for inner frames 20, 22. Therefore controller 36 will send an appropriate electrical signal to the high pressure hydraulic fluid side to either the cylinder assemblies 26, 28 of inner frame plates 20, 22 or to assemblies 24, 30 of outer frame plates 16, 18 or both to independently regulate the amount of fluid flowing to the inner and outer frame plates in order to obtain a uniform load distribution on the bolsters 12, 14, and ergo, the board for uniform compression and thus uniform thickness of the board in the present invention. Regardless of the length of the particleboard, the bolsters 12, 14 are caused to deflect the same amount and in the same direction in order to produce equal distance between the bolsters along their length resulting in uniform thickness for the product.

As mentioned above, in a manner which is apparent to one skilled in the art, pressure transducers 68, 72 and strain links 34 can be activated by the programmable controller 36 to act as a safety device to prevent overloading, and therefore, damage to press 10.

While considerable emphasis has been placed herein on the preferred embodiment disclosed and described, it will be appreciated that many embodiments of the invention can be made and many changes can be made in the preferred embodiment without departing from the scope and spirit of the present invention. For instance, the present invention can be used in multi-platen presses, and additional frame plates can be provided.

It will be appreciated that the cylinders 24, 26, 28 and 30, represented by $C_1$, $C_2$ need not be along the same centerline of the force of the frame plates represented by $F_1$, $F_2$; i.e. $F_1$ need not be in line with $C_1$ nor $F_2$ in line with $C_2$.

In accordance with the patent statutes, I have explained the operation and principles of my invention, and have described and illustrated what I consider to be the best embodiment thereof.

I claim:

1. A press for compressing particleboard or the like, having a cooperative stationary bolster and a movable bolster between which said particleboard is supported for said compression resulting in a loading of said press, and wherein said bolsters have a length substantially equal to the maximum length for said particleboard, said press comprising:

at least four tandemly arranged, generally equally spaced apart frame plates along said length for supporting said stationary and movable bolsters in said cooperative manner and cooperatively arranged to receive said loading, and during which said stationary bolster is subject to deflection along its said length, force applying means associated with each frame plate having a predetermined spaced relationship with respect to its said frame plate and connected to said movable bolster for moving said movable bolster towards said stationary bolster to compress said particleboard, means for each said frame plate for determining the amount of stretch of each said frame plate due to said loading during said compression of said particleboard, said determining means generating a signal representative of said amount of stretch of its said frame plate, and control means for receiving said signals from said determining means and for operating said force applying means of the innermost frame plates as a unit and said force applying means of the outermost frame plates as a unit with respect to said signals to cause said movable bolster to assume a said length deflection substantially the same as said length deflection of said stationary bolster under said pressing operation thereby establishing a substantially equal pressure distribution along the total length of said particleboard.

2. A press according to claim 1, wherein said determining means is on each said frame plate and consists of a number of strain links located near said bolsters.

3. A press according to claim 1, wherein said force applying means is an hydraulic cylinder assembly means mounted on each said frame plate and selectively connectable to a low pressure fluid source and a high pressure fluid source relative to said low pressure source, and wherein said outermost frame plates are located near the ends of said bolsters and said innermost frame plates are located near the center of said bolsters.

4. A press according to claim 3, wherein said control means includes means for regulating the output force of said hydraulic cylinder assembly means of both said inner and outer frame plates for said compression of said particleboard, including independent means for delivering said hydraulic fluid from said high pressure source to said cylinder assembly means of said inner frame plates separate from that of said outer frame plates such that when a board shorter in length than said bolsters varies said loading, the pressure in said cylinder assemblies of said inner frame plates varies from that of said outer frame plates to provide a pressure distribution along said length of said bolsters producing a substantially uniform thickness for said particleboard.

5. A press according to claim 3, wherein said outer frame plates consists of at least two frame plates each at said end of said bolsters, and said inner frame means consists of at least two spaced apart cooperating frame plates having a distance therebetween which is less than the minimum length value for said particleboard.

6. A press according to claim 5, wherein said control means further includes means for selectively controlling the output force of said cylinder assemblies of said outer frame plates and the output force of said cylinder assemblies of said inner frame plates either simultaneously or independently.

* * * * *